United States Patent [19]

Odenwälder et al.

[11] 4,420,557

[45] Dec. 13, 1983

[54] COLOR PHOTOGRAPHIC RECORDING MATERIAL CONTAINING A NON-DIFFUSIBLE ELECTRON DONOR PRECURSOR COMPOUND

[75] Inventors: Heinrich Odenwälder; Paul Marx, both of Leverkusen, Fed. Rep. of Germany

[73] Assignee: Agfa-Gevaert Aktiengesellschaft, Leverkusen, Fed. Rep. of Germany

[21] Appl. No.: 436,581

[22] Filed: Oct. 25, 1982

[30] Foreign Application Priority Data

Nov. 5, 1981 [DE] Fed. Rep. of Germany ..... 3144037

[51] Int. Cl.[3] ..... G03C 1/40; G03C 1/48; G03C 1/06; G03C 5/30

[52] U.S. Cl. ..... 430/559; 430/214; 430/218; 430/223; 430/443; 430/483; 430/484; 430/485; 430/551; 430/566; 430/959

[58] Field of Search ..... 430/218, 223, 440, 442, 430/443, 483, 484, 485, 557, 959, 559, 566, 214, 551

[56] References Cited

U.S. PATENT DOCUMENTS 4,232,107 11/1980 Janssens ..... 430/218
4,278,750 7/1981 Chen ..... 430/218

OTHER PUBLICATIONS

"Electron Donor Precusors", *Research Disclosure,* No. 19429, 6/80, pp. 212 & 213.

*Primary Examiner*—Richard L. Schilling
*Attorney, Agent, or Firm*—Connolly & Hutz

[57] ABSTRACT

Compounds corresponding to the formula:

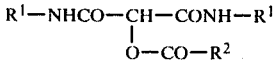

wherein $R^1$ represents an aromatic group, and $R^2$ represents H, alkyl, alkenyl, aryl or acyl, are suitable ED precursor compounds for use in color photographic recording materials. They are preferably used in combination with reducible dye releasers. They are also suitable as so-called scavengers.

5 Claims, No Drawings

COLOR PHOTOGRAPHIC RECORDING MATERIAL CONTAINING A NON-DIFFUSIBLE ELECTRON DONOR PRECURSOR COMPOUND

This invention relates to a color-photographic recording material comprising at least one light-sensitive silver halide emulsion layer, and containing one or more non-diffusible electron donor precursor compounds, from which strong reducing agents are formed under alkaline development conditions. The invention relates in particular to a recording material in which the electron donor precursor compounds mentioned are used in combination with non-diffusing reducible color-providing compounds which, in a reduced condition, release diffusible dyes under alkaline development conditions, which dyes are used as such or after being converted into the metal complexes thereof for image formation.

German Offenlegungsschrift No. 2,809,716 describes color-providing compounds containing an electron-accepting nucleophilic precursor group, which compounds, in a reduced condition, are subjected to an intramolecular nucleophilic displacement reaction under alkaline development conditions, with the release of a diffusible dye.

The reduction is caused by so-called electron donor compounds (ED compounds) which are contained in the layers in addition to the color-providing compounds and are oxidized image-wise during development and are thus consumed.

The remaining image-wise distribution (positive residual image) of the ED compounds reacts with the color-providing compound and initiates the image-wise release of diffusible dyes. The ED compounds which are described in this Offenlegungsschrift are, for example, derivatives of benzisoxazolone, hydroquinone, p-aminophenol and ascorbic acid. In order to allow the production of qualitatively high-grade images according to the process described in the above-mentioned German Offenlegungsschrift, the ED compounds do not only have to be oxidized by exposed silver halide or by silver halide developer oxidation products, but they must also themselves be capable of reducing the color-providing compounds. Moreover, the respective rates of the oxidation or reduction reaction must be optimally coordinated with each other so that the ED compound is already oxidized to a noticeable extent in the course of development, before it is capable for its part of reducing the color-providing compound. The known ED compounds do not satisfy these requirements in every respect, which is shown, for example, in an inadequate color density and/or in an unacceptable color fog of the color transfer images which have been produced.

The high reducing power of suitable ED compounds simultaneously is accompanied by a high sensitivity to oxidation which is expressed, during comparatively long storage of the photographic recording material, in a premature, non-imagewise consumption of the ED compounds by oxidation and in image properties of the transfer image which are impaired thereby, in particular an inadequate color density. It is also known from German Offenlegungsschrift No. 2,809,716 that ED compounds may not be used as such, but in the form of a less oxidation-sensitive precursor compound, from which the actual ED compound is formed only under the conditions of alkaline development. Examples of these compounds include the ED compounds ED-8, ED-9 and ED-10 of the German Offenlegungsschrift mentioned. However, only an inadequate density of the color transfer image is obtained with the known ED precursor compounds within an acceptable development time, which may be caused either by the actual ED compound not being produced rapidly enough from its precursor compound or by the ED compound having too low a reducing power. ED-precursor compounds which are described in Research Disclosure 19429 (June 1980) are derived from α-hydroxy-ketones and have an electron-attracting group Z at the α-carbon atom.

THE SUMMARY OF THE INVENTION

The present invention provides new oxidation-stable ED precursor compounds which result in a good storage stability of the photographic material at elevated temperature and/or elevated moisture and from which ED compounds having a high reducing power are formed only under the conditions of alkaline development. In particular, these compounds should allow the production of color transfer images of improved color density in the dye diffusion transfer process when used in a combination with non-diffusing reducible color-providing compounds.

This invention provides a color photographic recording material comprising at least one light-sensitive silver halide emulsion layer and a non-diffusing color-providing compound associated with this layer, which recording material contains, in at least one light-sensitive silver halide emulsion layer or in a non-light-sensitive binder layer, a non-diffusing electron donor precursor compound (ED precursor compound), from which a non-diffusing ED compound is formed under alkaline development conditions, characterized in that the ED precursor compound corresponds to the following formula I:

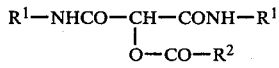

$$R^1-NHCO-\underset{\underset{O-CO-R^2}{|}}{CH}-CONH-R^1 \qquad (I)$$

wherein $R^1$ represents a carbocyclic or heterocyclic aromatic group;

$R^2$ represents, hydrogen, alkyl, alkenyl, aryl or acyl, and at least one of the radicals $R^1$ and $R^2$ contains a ballast radical.

DETAILED DESCRIPTION OF THE INVENTION

The ED precursor compounds according to the present invention are widely suitable for use in color photographic recording materials where it is required to introduce into the layers strong reducing agents in masked form, whether as a masked developing agent for silver halide or as masked reducing agent to prevent the undesired diffusion of oxidation products which are produced from silver halide development. It is of no importance here which type of color-providing compounds are used to produce the color images. They may be color couplers or color-providing compounds which release diffusible dyes as a result of development (dye releasers). However, the preferred use of the ED precursor compounds according to the present invention is seen in a combination with non-diffusing, reducible color-providing compounds which, in a reduced form, release diffusible dyes under alkaline development conditions.

Thus the present invention preferably provides a color photographic recording material comprising at least one light-sensitive silver halide emulsion layer and in association therewith, a combination of a non-diffusing, reducible color-providing compound which, in a reduced condition, is capable of releasing a diffusible dye under alkaline development conditions, and a non-diffusing electron donor precursor compound (ED-precursor compound), from which a non-diffusing electron donor compound (ED compound) is formed under alkaline development conditions, the ED compound being capable of reducing the non-diffusing color providing compound under alkaline development conditions, characterised in that the recording material contains a compound corresponding to the general formula I as the ED precursor compound.

The aromatic group represented in formula I by $R^1$ may be a carbocyclic group, for example, a phenyl, naphthyl or an anthracenyl group or a 5- or 6-membered heterocyclic group having at least one of the hetero atoms N, O, S as a ring member, for example, a furyl, thienyl, pyrryl or pyridyl group. The carbocyclic and heterocyclic aromatic groups may be unsubstituted or mono- or polysubstituted, and may contain carbocyclic or heterocyclic rings condensed thereon which do not need to be aromatic in this case.

The aryl group represented in formula I by $R^2$ is in particular a phenyl group which may also be mono- or poly-substituted.

The acyl group represented in formula I by $R^2$ is derived from aliphatic or aromatic carboxylic acids of the formula R-COOH, wherein R represents an alkyl, alkenyl, aryl or heterocyclic group, or is a carbamoyl radical for example.

The following are included, for example, as substituents of the aromatic groups represented by $R^1$ and of the aryl group represented by $R^2$: halogens, such as fluorine, chlorine, bromine or iodine, hydroxy, sulfo, sulfamoyl, trifluoromethyl, trifluoromethylyulfonyl, amino, nitro, cyano, carboxy, carbamoyl, alkoxycarbonyl, alkyl, alkenyl, cycloalkyl, in particular cyclohexyl or cyclopentyl, aryl, in particular phenyl, or heterocyclic groups, and the last-mentioned groups (alkyl, alkenyl, cycloalkyl, aryl and heterocyclic groups) may contain further substituents, for example, those of the previously mentioned type, and the alkyl, alkenyl, cycloalkyl, aryl or heterocyclic groups mentioned are either joined directly or by one of the following divalent connecting links to the remainder of the molecule: —O—, —S—, —$SO_2$—, —$SO_2$—NR—, —NR—$SO_2$—, —CO—, —NR—CO—, —CO—NR—, NR—COO—, —O—CO—NR—, —NR—CO—NR— (R=hydrogen or alkyl).

The alkyl or alkenyl groups which are represented by $R^2$ or are present as a substituent in $R^1$ and $R^2$ may be straight or branched, may contain from 1 to 22 carbon atoms and may optionally also be further substituted, for example by halogen (such as fluorine, chlorine, or bromine), hydroxy, amino, alkoxy, aroxy, alkylthio, arylthio, a heterocyclic thioether group, alkylsulfonyl, arylsulfonyl or a heterocyclic group, such as a 5- 6-membered heterocyclic ring which is joined via a ring nitrogen atom.

In preferred embodiments of the present invention, $R^1$ is an optionally substituted phenyl group and $R^2$ in preferred embodiments is an alkyl radical containing from 1 to 3 carbon atoms which may optionally be substituted by halogen, alkoxy, aroxy or hydroxyl.

According to the present invention, all of the substituents present in the ED precursor compound are constituted such that the ED precursor compound can be embedded in a non-diffusible form in photographic layers. For this purpose, for example, at least one of the substituents present, for example at least one of the radicals $R^1$ and $R^2$, contains a ballast radical. The radical $R^1$ is preferably constituted such that even after splitting off the acyl radical —$COR^2$ under the influence of alkali, the residual molecule remains diffusion-resistant or has only a limited diffusibility. A diffusion-resistant embedding of the ED precursor compound is particularly desirable, because these compounds are used in an exact localization in a specific layer or in a specific quantitative relation to associated, non-diffusing, reducible color-providing compounds which should not undergo substantially any changes as far as possible even during a comparatively long storage of the photographic recording material.

Ballast radicals are considered to be those which allow the compounds according to the present invention to be embedded in a diffusion-resistant manner in the hydrophilic colloids which are usually used in photographic materials. Organic radicals preferably suitable for this purpose are those which generally contain straight-chain or branched aliphatic groups generally having from 8 to 22 carbon atoms, and optionally also carbocyclic or heterocyclic aromatic groups. These radicals are joined to the remaining part of the molecule either directly or indirectly, for example by one of the following groups: —NHCO—, —$NHSO_2$—, —NR—, wherein R represents hydrogen or alkyl, —O— or —S—. The radical conferring diffusion resistance may also contain water-solubilizing groups, for example sulfo groups or carboxyl groups, which may also be present in certain cases in anionic form. Since the diffusion properties depend on the molecule size of the complete compound used, it suffices in certain cases, for example if the complete molecule which is used is large enough, or if the ED precursor compounds are worked into the layers in emulsified form while using so-called oil formers or high-boiling coupler solvents, also to use shorter-chain radicals, for example isoamyl- or tert.-butyl radicals as ballast radicals.

A few examples of the non-diffusible ED precursor compounds which are used according to the present invention are given in the following.

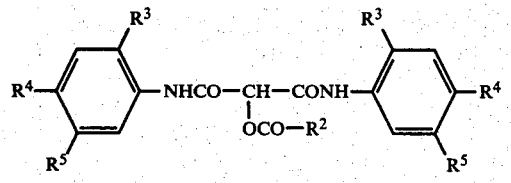

| Compound | $R^2$ | $R^3$ | $R^4$ | $R^5$ |
|---|---|---|---|---|
| 1 | $CH(OCH_3)_2$ | Cl | H | $COO—n\text{-}C_{12}H_{25}$ |
| 2 | $CH_2—O—C_2H_5$ | $CH_3$ | H | $COO—n\text{-}C_{16}H_{33}$ |
| 3 | 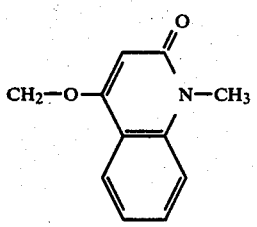 | $CH_3$ | H | $COO—n\text{-}C_{10}H_{21}$ |
| 4 | 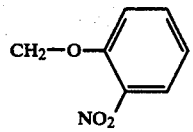 | $OCH_3$ | H | 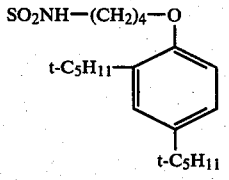 |
| 5 | $CH_2—O—CH_2—O—CH_3$ | H | H | $COO—n\text{-}C_{12}H_{25}$ |
| 6 | $CH_2Cl$ | H | $COO—n\text{-}C_{16}H_{33}$ | H |
| 7 | 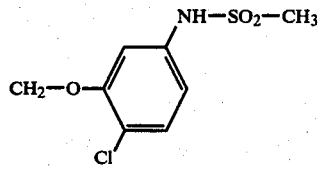 | Cl | H | $SO_2N(i\text{-}C_3H_7)_2$ |
| 8 | $CH—CH_3$ (OH) | H | Cl | $COO—n\text{-}C_{16}H_{33}$ |
| 9 | 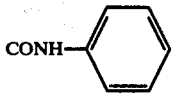 | H | H | $NHCO—n\text{-}C_{11}H_{23}$ |
| 10 | $CH_3$ | H | $COO—n\text{-}C_{16}H_{33}$ | H |
| 11 | $CH_2—O—C_2H_5$ | H | H | $COO—n\text{-}C_{16}H_{33}$ |
| 12 | $CH_3$ | H | Cl | $COO—n\text{-}C_{16}H_{33}$ |
| 13 | $CH_3$ | $CH_3$ | H | $COO—n\text{-}C_{16}H_{33}$ |

The ED compounds according to the present invention are α-substituted malonic acid diamides. The starting materials for the production thereof are appropriately aromatic amines of the formula $R^1\text{-}NH_2$ which are condensed with diethyl malonate with the release of ethanol. The α-bromo compound is produced from the resulting malonic acid diamide by known methods. The bromine atom is then exchanged for the radical —O—CO—$R^2$. The production process will now be explained in the following using the example of compound 2.

Production of compound 2

(a) 15.1 g of 3-amino-4-methyl-benzoic acid were mixed in 150 ml of dimethylformamide with 13.8 g of potassium carbonate and 30.5 g of hexadecyl bromide and were heated for 2 hours on a boiling water bath with stirring. After being cooled to room temperature, the reaction mixture was stirred in a mixture of 300 ml of methanol and 30 ml of water. The resulting deposit was suction-filtered and stirred successively into 200 ml of water and 300 ml of methanol, was re-filtered with suction and dried in air. Yield: 29 g.

(b) 30 g of the resulting compound and 6.4 g of malonic acid diethylester were gradually heated to 220° C., with the ethanol released being distilled off, and were maintained for 2 hours at this temperature. The reaction mixture was then stirred with 50 ml of methanol and was suction-filtered. After again being stirred with 50 ml of cyclohexane, 11 g of malonic acid anilide were obtained.

(c) 6.5 g of the compound obtained under (b) were mixed with 0.41 ml of bromine in a suspension in 50 ml of glacial acetic acid with stirring. The mixture was heated for 15 minutes to 60° C. After cooling to room temperature and after adding 50 ml of methanol, the deposit formed was suction-filtered and washed with methanol. Yield: 5.8 g.

Compound 2

2.4 g of ethoxyacetic acid and 2.1 g of potassium carbonate are added successively to 13.5 g of the compound obtained under (c) in 120 ml of dimethylacetamide and the reaction mixture was stirred for 3 hours at room temperature. The reaction mixture was then poured at 10° C. into a mixture of 300 ml of methanol, 30 ml of water and 10 ml of glacial acetic acid. The resulting deposit was suction-filtered and stirred successively with 200 ml of water and 200 ml of methanol, then suction-filtered, washed with 50 ml of methanol and dried in air. Yield: 11 g.

The ED precursor compounds according to the present invention are superior to the known ED compounds, for example ascorbyl palmitate, and also to the known ED precursor compounds insofar as higher maximum color densities may be produced simultaneously with lower minimum color densities (fog) with these compounds within a given development time. It remains to be seen whether the higher maximum color densities which are obtained are to be attributed to a ready splitting-off (hydrolysis) of the acyl radical and thus to a more rapid availability of the actual ED compounds, or to the higher reducing power thereof, or to both factors.

Another advantage of the ED precursor compounds according to the present invention is that they are in an oxidation-insensitive form and are only converted into the actual ED compounds during development by treating with aqueous alkali (hydrolytic splitting-off of the acyl group).

The reducible dye releasers which are used in combination with the ED precursor compounds according to the present invention release a diffusible dye under alkaline development conditions by reduction or as a consequence of a reduction. Reducible dye releasers are described in the following publications: German Offenlegungsschrift Nos. 2,809,716; 3,008,588; 3,014,669; European published Patent Application No. 0,004,399 and British published Patent Application No. 80 12242. Reducible dye releasers which are particularly preferably used according to the present invention correspond to the following formula II:

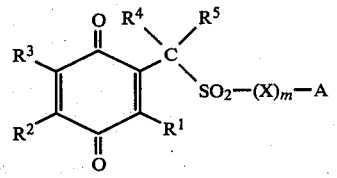

II wherein $R^1$ represents alkyl or aryl;

$R^2$ represents alkyl; aryl or a group which, together with $R^3$ completes a fused ring;

$R^3$ represents hydrogen, alkyl, aryl, hydroxyl, halogen such as chlorine or bromine, amino, alkylamino, dialkylamino including cyclic amino groups (such as piperidino, morpholino), acylamino, alkylthio, alkoxy, aroxy, sulfo or a group which, together with $R^2$ completes a fused ring;

$R^4$ represents alkyl;

$R^5$ represents alkyl or, what is preferred, hydrogen;

A represents the radical of a diffusible dye or dye precursor;

X represents a bivalent connecting member of the formula $—R—(L)_p—(R)_q—$, wherein R represents an alkylene radical having from 1 to 6 carbon atoms or an optionally substituted arylene or aralkylene radical, and the two bivalent radicals R may have the same or different meanings;

L represents —O—, —CO—, $—CONR^6—$, $—SO_2NR^6—$, $—O—CO—NR^6—$, —S—, —SO— or $—SO_2—$ ($R^6$=hydrogen or alkyl);

p represents 0 or 1;

q represents 0 or 1; and m represents 0 or 1, and at least one of the radicals $R^1$, $R^2$, $R^3$ and $R^4$ contains a ballast radical.

The alkyl radicals represented in formula II by $R^1$, $R^2$, $R^3$ and $R^5$ may be straight-chain or branched and usually contain up to 18 carbon atoms. Examples thereof include methyl, n-propyl, tert.-butyl, tetradecyl and octadecyl. The aryl radicals represented by the radicals $R^1$, $R^2$ and $R^3$ mentioned are, for example, phenyl groups which may be substituted, for example by long-chain alkoxy groups.

In an acylamino radical represented by $R^3$, the acyl group is derived from aliphatic or aromatic carboxylic acids or sulfonic acids. The fused rings which are completed by $R^2$ and $R^3$ are preferably carbocyclic rings, for example fused benzene or bicyclo [2,2,1] heptene rings.

An alkyl radical represented by $R^4$ may be straight-chain or branched, substituted or unsubstituted and may contain up to 21 carbon atoms. Examples include methyl, nitromethyl, phenylmethyl (benzyl), heptyl, tridecyl; pentadecyl, heptadecyl and $—C_{21}H_{43}$.

Preferred embodiments of the dye releasers which are used according to the present invention are those in which $R^1$, $R^2$ and $R^3$ in a quinoid carrier radical together contain not more than 8, in particular not more than 5 carbon atoms, and $R^4$ represents an alkyl radical having at least 11 carbon atoms.

Preferred embodiments are also those in which $R^1$ represents an alkoxyphenyl radical having at least 12 carbon atoms in the alkoxy group and $R^2$, $R^3$ and $R^4$ together do not contain more than 8 carbon atoms.

The reducible dye releasers which are preferably used contain per dye radical A a releasable quinoid carrier radical conferring diffusion resistance of the formula:

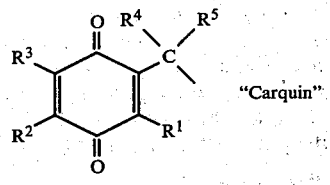

"Carquin"

wherein $R^1$, $R^2$, $R^3$, $R^4$ and $R^5$ have the meanings which have already been given.

In principle, the radicals of dyes of all dye classes are suitable as dye radicals, if they are sufficiently diffusible in order to be able to diffuse through the layers of the light-sensitive material into the image-receiving layer. For this purpose, the dye radicals may be provided with one or more alkali-solubilizing groups. The following inter alia are suitable as alkali-solubilizing groups: carboxyl groups, sulfo groups, sulfonamide groups and aromatic hydroxyl groups. Such alkali-solubilizing groups may already be preformed in the dye releasers used according to this invention, or may only be produced as a result of splitting off of the dye radical from the carrier radical loaded with ballast groups. The following are mentioned as dyes which are particularly suitable for the present process: azo dyes, azomethine dyes, anthraquinone dyes, phthalocyanine dyes, indigoid dyes, triphenylmethane dyes, including those dyes which are complexed or may be complexed with metal ions.

The term "radicals of dye precursors" is understood to mean the radicals of such compounds which are converted into dyes in the course of photographic processing by conventional or additional processing steps, whether by oxidation or by coupling, by complex formation or by exposing an auxochromic group in a chromophoric system, for example by saponification. Dye precursors in this context may be leuko dyes, couplers or dyes which are converted into other dyes during processing. As far as a differentiation between dye radicals and the radicals of dye precursors is not of paramount importance, the latter should also be understood in the following under the term "dye radicals".

In a preferred embodiment of the present invention, the color photographic recording material in monochromatic processes contains at least one image-producing layer unit, and in processes for the production of multicolored images, the color photographic recording material usually contains at least three image-producing layer units, of which each contains at least one light-sensitive silver halide emulsion layer and, associated with this layer a combination of a non-diffusing reducible, dye releaser and an electron donor compound, one ED precursor compound according to the present invention being used in at least one layer unit. One of the layer units is usually mainly sensitive to blue light, another layer unit is mainly sensitive to green light and a third unit is mainly sensitive to red light, the associated dye releasers in each case providing complementary image dyes.

The terms "association" and "associated" are understood to mean that the mutual arrangement of silver halide emulsions, ED compound or ED precursor compound and dye releaser is such that an interaction is possible between them which allows an image wise conformity between the silver image which has formed and the consumption of ED compound on the one hand and between the unconsumed ED compound and the dye releaser on the other hand, so that in conformity with the undeveloped silver halide, an image wise distribution of diffusible dye is produced. For this purpose, the light-sensitive silver halide and the combination of dye releaser and ED compound do not necessarily have to be in the same layer. They may also be accommodated in adjacent layers which in each case belong to the same layer unit.

In order to ensure an adequate interaction between the dye releaser and the associated ED precursor compound, it is advisable to accommodate both these compounds of one combination in the same layer which, however, does not have to be identical to the associated silver halide emulsion layer. The fact that the ED precursor compounds according to the present invention are stable to hydrolysis under neutral conditions and thus are also oxidation-insensitive means that these compounds are particularly suitable for use in a common emulsion (together with the dye releaser), while conventional ED compounds have too high an oxidation sensitivity under comparable conditions, so that they cannot be used in the same emulsion with the dye releasers.

The methods suitable for working in the ED precursor compounds of the present invention are any of those by which hydrophobic compounds are usually worked into photographic layers, i.e., the conventional emulsifying techniques are included, for example methods by which photographic auxiliaries are added to the casting solutions in the form of emulsifying agents using so-called oil formers. During this process, all methods which necessitate the use of alkali should appropriately be avoided.

The reducible dye releaser is usually used in a layer in a sufficient quantity for producing a color image having as high a maximum color density as possible, for example in a quantity of from 1 to $20.10^{-4}$ mol/m$^2$. The quantity of ED precursor compound according to this invention is adapted to the quantity of the dye releaser. It should be sufficient in order to achieve as high a maximum color density as possible, i.e., to be able to cause as complete a reduction of the dye releaser as possible. On the other hand, it should not be substantially higher than required for this purpose, so that the reducing agent which is produced from its precursor at the exposed points may be consumed as completely as possible by the development of the exposed silver halide. The quantitative ratios which are most favourable in individual cases between silver halide, ED precursor compound and dye releaser are appropriately determined by routine experiments. Reliable results may be obtained, for example, when the ED precursor compound is present in each case in from 0.5 to 5 times the molar quantity based on the dye-releaser. The suitable quantitative ratio between silver halide and the associated dye releaser approximately ranges from 2 to 20 mols of silver halide per mol of dye releaser.

Intermediate layers are appropriately present between different layer units and they may contain compounds which are capable of reacting with diffusing development products and are capable of stopping the diffusion thereof from one layer unit into another. This contributes to the fact that the association remains restricted in each case to one layer unit. Compounds of this type are known. For example, non-diffusing hydroquinone derivatives and, for example, the "scavenger compounds" described in the publication "Research Disclosure No. 17 842" are suitable for this purpose. Not least may the ED precursor compounds according to this invention also take over this function, that is, independently of the type of color-providing compound which is used (color coupler, dye releaser), if the ED precursor compounds of the present invention are embedded as so-called scavengers in a intermediate layer between different layer units.

The interaction between the exposed silver halide and the ED compound is generally caused by the oxidized form of the silver halide developing agent which is used. The latter is oxidized image wise during development and the oxidation product is for its part capable of oxidizing the ED compound and thus of withdrawing it from the reaction with the dye releaser.

The following, for example, are included as silver halide developing agents: hydroquinone and the derivatives thereof, catechol and the derivatives thereof, p-phenylenediamine derivatives and 3-pyrazolidone compounds, in particular 1-phenyl-3-pyrazolidone, 1-phenyl-4,4-dimethyl-3-pyrazolidone, 4-hydroxymethyl-4-methyl-1-phenyl-3-pyrazolidone, 1-phenyl-4-methyl-3-pyrazolidone, 1-phenyl-5-methyl-3-pyrazolidone, 1-phenyl-4,4-bis-(hydroxymethyl)-3-pyrazolidone, 1,4-dimethyl-3-pyrazolidone, 4-methyl-3-pyrazolidone, 4,4-dimethyl-3-pyrazolidone, 1-(3-chlorophenyl)-4-methyl-3-pyrazolidone, 1-(4-chlorophenyl)-4-methyl-3-pyrazolidone, 1-(3-chlorophenyl)-3-pyrazolidone, 1-(4-chlorophenyl)-3-pyrazolidone, 1-(4-tolyl)-4-methyl-3-pyrazolidone, 1-(4-tolyl)-4-hydroxymethyl-4-methyl-3-pyrazolidone, 1-(3-tolyl)-3-pyrazolidone, 1-(3-tolyl)-4,4-dimethyl-3-pyrazolidone, 1-(2-trifluoroethyl)-4,4-dimethyl-3-pyrazolidone and 5-methyl-3-pyrazolidone, including those derivatives of 3-pyrazolidone which are present in masked form, for example acetylated phenidone derivatives.

A combination of different silver halide developing agents may also be used. The silver halide developing agents may be contained in an alkaline developer preparation or may be completely or partly contained in one or more layers of the color-photographic recording material to be processed.

In order to carry out the dye diffusion transfer process according to the present invention, a light-sensitive element is usually used which contains one or more silver halide emulsion layer units and the reducible dye releasers associated therewith and ED compounds or the precursors thereof, and an image-receiving element, in which the required color image is produced by the imagewise transfer of the released dyes. For this purpose, there must be a firm contact between the light-sensitive element and the image-receiving element at least during a finite period of time within the developing time, so that the imagewise distribution of diffusing dyes which is produced in the light-sensitive element as a result of development may be transferred onto the image-receiving element.

The contact may be produced after development has been started, or it may already have been produced before development starts. The latter is the case, for example, if a so-called integral recording material is used for carrying out the dye diffusion transfer process, in which material the light-sensitive element and the image-receiving element form an integral unit, also termed in the following a "monosheet material" which may still exist at the end of the development procedure, if the light-sensitive element is not separated from the image-receiving element after the color transfer has been completed. An embodiment of this type is described, for example, in German Offenlegungsschrift No. 2,019,430.

Accordingly, the image-receiving element may be a component of the color photographic recording material, for example in the form of an image-receiving layer which is positioned on a transparent substrate below the light-sensitive element, a light-impervious, preferably a light-reflecting, binder layer appropriately being located between the image-receiving layer and the light-sensitive element. The image-receiving layer which, in another form of the color transfer process may, however, also be positioned on a separate substrate (image-receiving sheet) usually contains in a known manner a basic mordant for diffusing anionic (acid) dyes.

Long-chain quaternary ammonium or phosphonium compounds or tertiary sulfonium compounds, for example those compounds which are described in U.S. Pat. Nos. 3,271,147 and 3,271,148, are preferably used as mordants for acid dyes. Furthermore, certain metal salts and the hydroxides thereof which form sparingly soluble compounds with the acid dyes may also be used. The dye mordants are dispersed in the receiving layer in one of the conventional hydrophilic binders, for example in gelatine, polyvinyl pyrrolidone or completely or partially hydrolysed cellulose esters. Of course, some binders may also function as mordants, for example mixed polymers or polymer mixtures of vinyl alcohol and N-vinylpyrrolidone, as described, for example, in German Auslegeschrift No. 1,130,284, also those which are polymers of nitrogenous quaternary bases, for example polymers of N-methyl-2-vinylpyridine, as described, for example, in U.S. Pat. No. 2,484,430. Other modanting binders which may be used include, for example, guanylhydrazone derivatives of alkyl vinylketone polymers, as described in U.S. Pat. No. 2,882,156, or guanylhydrazone derivatives of acylstyrene polymers, as described, for example, in German Offenlegungsschrift No. 2,009,498.

However, other binders, for example gelatine, are generally also added to the last-mentioned mordanting binders. Other polymeric mordants are described in U.S. Pat. No. 3,709,690 and in German Offenlegungsschrift Nos. 2,315,304; 2,445,782; 2,551,786 and 2,631,521.

Moreover, the color photographic recording material according to the present invention may also contain acid layers and so-called retarding or delaying layers which together form a so-called integral neutalization system. An integral neutralization system of this type may be positioned in a known manner between the substrate and the image-receiving layer position thereon, or at another point in the laminated structure, for example above the light-sensitive layers, i.e., on the other side of these light-sensitive layers, seen from the image-receiving layer. The neutralization system is usually orientated such that the retarding or delaying layer is positioned between the acid layer and the point at which an alkaline developing liquid or developing paste is applied. Such acid layers, retarding layers etc., from both existing neutralization systems are known, for example, from U.S. Pat. Nos. 2,584,030; 2,983,606; 3,362,819; 3,362,821 and from German Offenlegungsschrift Nos. 2,455,762; 2,601,653; 2,716,505 and 2,816,878. A neutralization system of this type may also contain in a known manner two or more retarding layers.

Moreover, in a particular embodiment, the recording material according to the present invention may contain one or more pigmented, opaque layers which are permeable to aqueous liquids. These layers may fulfil two functions: On the one hand, the layers may prevent the undesired entry of light into light-sensitive layers and on the other hand, a pigment layer of this type, in particular if a light or white pigment, for example $TiO_2$, is used, may form an aesthetically pleasing background for the colour image which is produced. Integral color photographic recording materials having a pigment layer of this type are known, for example from U.S. Pat. No. 2,543,181 and from German Auslegeschrift No. 1,924,430. Instead of a preformed opaque layer, means may also be provided to produce such layers only during the course of the development process. Corresponding to the two functions mentioned, pigment layers of this type may comprise two or more partial layers, one of which contains a white pigment, for example, and the other contains, for example, a dark, light-absorbing pigment, for example carbon black.

In a particularly preferred embodiment of the present invention, the photographic material is an integral color photographic recording material for carrying out the dye diffusion transfer process and it has, for example, the following layer elements.

(1) A transparent layer support,
(2) An image-receiving layer,
(3) A light-reflecting layer,
(4) A light-sensitive element with at least one light-sensitive silver halide emulsion layer and associated with this layer, a combination of reducible dye releaser and ED precursor compound,
(5) a retarding layer,
(6) an acid polymer layer, and
(7) a transparent layer support.

The monosheet material may be assembled such that two different parts are produced separately from each other, namely the light-sensitive part (layer elements 1 to 4) and the covering sheet (layer elements 5 to 7) which are then positioned one on top of the other on the layer side and are joined together, optionally using spacing strips, so that a space is formed between the two parts for receiving an exactly measured quantity of a developer preparation. The layer elements 5 and 6 which together form the neutralization system may also be positioned between the layer support and the image-receiving layer of the light-sensitive part, but in reverse order.

Furthermore, means may also be provided for introducing a developer preparation between the light-sensitive part and the covering sheet, for example in the form of a rupturable container which is positioned at the side and discharges its contents between two adjacent layers of the monosheet material under the influence of mechanical forces.

In addition to aqueous alkali, the developer preparation may also contain developer compounds which, however, must be co-ordinated with the type of color-providing compounds. Other possible components of the developer preparation include thickening agents to increase the viscosity, for example hydroxyethyl cellulose, silver halide solvents, for example sodium thiosulfate or one of the bis-sulfonyl alkane compounds described in German Offenlegungsschrift No. 2,126,661, opacifiers to produce opaque layers, for example pigments of $TiO_2$, ZnO, barium sulphate, barium stearate or kaolin. Some of these components may alternatively or additionally be embedded in one or more layers of the color photographic recording material of the present invention.

EXAMPLE 1

Light-sensitive element

The following layers were successively supplied to a paper substrate which was coated on both sides with polyethylene. All the quantities relate to 1 $m^2$.

1. A red-sensitized silver bromo-iodide emulsion layer consisting of 0.5 g of $AgNO_3$ containing 0.3 g of the dye releaser A (=compound 2 from German Offenlegungsschrift No. 2,854,946), 0.16 g of ED compound 2, 0.46 g of palmitic acid diethyl amide (common oil former for A and ED compound) and 1.15 g of gelatine.
2. A protective layer containing 0.6 g of the monoacetylation product of 4-methyl-1-phenyl-3-pyrazolidone, 0.12 g of 2-isootadecyl-5-sulfohydroquinone and 0.6 g of gelatine.
3. A hardening layer containing 0.1 g of gelatine and 0.12 g of hardening agent D.

Image-receiving sheet

The following layers were applied to a paper substrate which was coated on both sides with polyethylene. The quantities relate to 1 square meter.

1. A mordant layer containing 6 g of a polyurethane according to Example 3 of German Offenlegungsschrift No. 2,631,521 and 5 g of gelatine.
2. A hardening layer containing 0.1 g of gelatine and 0.15 g of hardening agent D.

The light-sensitive element which is exposed imagewise and the image-receiving sheet were soaked with a treatment solution of the composition specified below and were compressed layer-to-layer:

921 g of $H_2O$,
25 g of 2,2-methylpropyl-1,3-propanediol,
20 g of 1,4-cyclohexanedimethanol 50%,
3 g of KBr, and
40 g of KOH.

After a contact time of 2 minutes, the sheets were separated from each other and the image-receiving sheet was rinsed for 30 seconds. After drying, the Dmin/Dmax values of the positive cyan image were measured.

EXAMPLES 2 TO 4

The process was carried out as stated in Example 1, but instead of the light-sensitive element described in Example 1, elements were used which, instead of containing the ED compound 2, contained other ED precursor compounds according to the present invention in the same molar quantity.

The results (Dmin/Dmax) are given in the following Table:

TABLE

| ED Compound | $D_{min}$ | $D_{max}$ |
|---|---|---|
| 2 | 0.14 | 2.24 |
| 11 | 0.29 | 2.27 |
| 12 | 0.16 | 2.06 |
| 13 | 0.15 | 2.36 |

EXAMPLE 5 (not according to the present invention)

A light-sensitive element of a photographic recording material according to the present invention was procuded by successively applying the following layers onto a transparent support consisting of polyethylene terephthalate. The quantities relate in each case to 1 $m^2$.

1. Blue-sensitized AgBr-negative emulsion consisting of 0.5 g of $AgNO_3$, containing 0.357 g of compound B (compound releasing yellow dye), 0.306 g of compound E (ED compound 4 from German Offenlegungsschrift No. 3,006,268), 0.663 g of palmitic acid diethylamide (oil former) and 1.164 g of gelatine.
2. Yellow filter layer containing 0.16 g of yellow dye Solvent Yellow 29 (C.I. 21230), 0.07 g of 2-isooctadecyl-5-sulfo-hydroquinone (scavenger) and 1.0 g of gelatine.

3. Green-sensitized AgBr-negative emulsion consisting of 0.5 g of $AgNO_3$, containing 0.314 g of compound C (compound releasing magenta dye) 0.223 g of compound E, 0.537 g of diethyl lauramide (oil former) and 1.037 g of gelatine.
4. Intermediate layer containing 0.4 g of 2-isooctadecyl-5-sulfo-hydroquinone, 0.60 g of acetylation product of 4-methyl-1-phenylpyrazolidone (3) (developer) and 1.0 g of gelatine.
5. Red-sensitized AgBr-negative emulsion consisting of 0.5 g of $AgNO_3$, containing 0.30 g of compound A (compound releasing cyan dye), 0.162 g of compound E, 0.462 g of palmitic acid-diethylamine and 0.962 g of gelatine.
6. Protective layer containing 0.6 g of gelatine.
7. Opaque light-reflecting layer containing 18 g of $TiO_2$ and 2.57 g of gelatine.
8. Protective layer containing 4.0 g of gelatine.
9. Image-receiving layer containing 2.08 g of a polymeric mordant consisting of 4,4'-diphenylmethanediisocyanate and N-ethyldiethanolamine, quaternized with epichlorohydrin according to German Offenlegungsschrift No. 2,631,521, Example 1, and 5.2 g of gelatine.
10. Protective and hardening layer containing 1.2 g of compound D (hardening agent) and 0.6 g of gelatine.

The recording material was exposed through the transparent support behind a conventional grey wedge and was developed in an open tray at 22° C. for 2 minutes using a bath of the following composition:

921 g of $H_2O$,
25 g of 2-methyl-2-propyl-1,3-propanediol,
20 g of 1,4-cyclohexanedimethanol 50%,
3 g of KBr, and
40 g of KOH.

The material was then rinsed for 5 minutes and was dried.

EXAMPLES 6 AND 7 (according to the present invention)

The process was carried out as stated in Example 5, but instead of the light-sensitive element described in Example 5, elements were used which contained, as the scavenger in layers 2 and 4, 1.5 g of one of the compounds 2 or 13 according to the present invention, and in each case 1.5 g of dibutyl phthalate as the oil former. Processing was carried out as in Example 5.

The recording materials obtained according to Examples 5, 6 and 7 produced transfer images of a comparatively good color separation.

When the recording materials were exposed to a climate of 60° C. (with uncontrolled moisture) 3 days before development and were then processed as described in Example 5, transfer images were obtained which, compared with the freshly developed samples, exhibited the following percent fog increase (positive values indicate a fog increase):

| Compound | $D_{min}$ B | G | R |
|---|---|---|---|
| 2-isooctadecyl-hydroquinonesulfonic acid | +7 | +10 | +19 |
| 2 | −2 | +3 | +4 |
| 13 | +2 | +4 | +5 |

As shown by the Table, the compounds according to the present invention may also be used particularly advantageously as scavengers for oxidized developers in photographic layers, due to their substantially lower fogging tendency.

Formula appendix to the Examples.

A

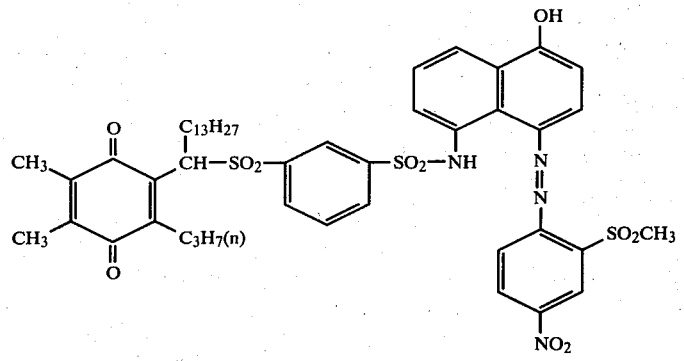

B

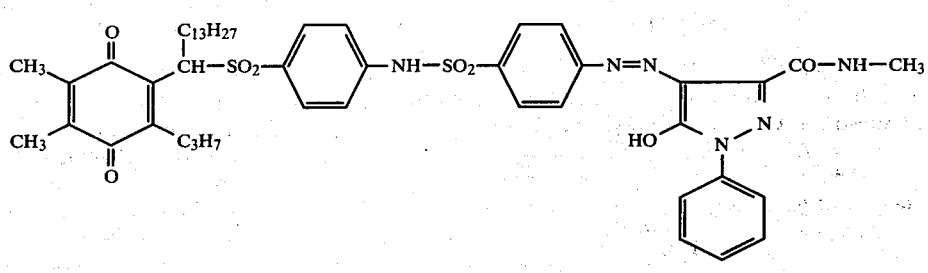

-continued

C

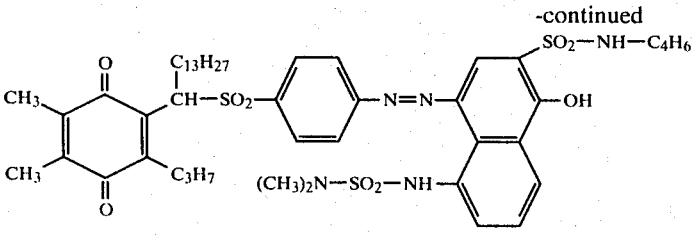

D

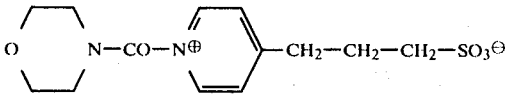

E

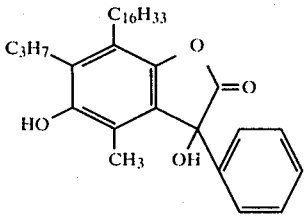

We claim:

1. A color photographic recording material comprising at least one light-sensitive silver halide emulsion layer and associated thereto a non-diffusing color-providing compound, which material contains, in at least one light-sensitive silver halide emulsion layer or in a non-light-sensitive binder layer, a non-diffusing electron donor precursor compound (ED precursor compound), from which a non-diffusing ED compound is formed under alkaline development conditions, wherein the improvement comprises the ED precursor compound corresponds to the following formula I $$R^1-NHCO-\underset{\underset{O-CO-R^2}{|}}{CH}-CONH-R^1 \qquad (I)$$

wherein $R^1$ represents a carbocyclic or heterocyclic aromatic group, $R^2$ represents hydrogen, alkyl, alkenyl, aryl or acyl; and at least one of the radicals $R^1$ and $R^2$ contains a ballast radical.

2. A color photographic recording material comprising at least one light-sensitive silver halide emulsion layer and, associated thereto a combination of a non-diffusing reducible color-providing compound which, in a reduced condition, is capable of releasing a diffusible dye under alkaline development conditions, and a non-diffusing electron donor precursor compound (ED precursor compound) from which a non-diffusing electron donor compound (ED compound) is formed under alkaline development conditions, which ED compound is capable of reducing the non-diffusing color-providing compound under alkaline development conditions wherein the improvement comprises the recording material contains as the ED precursor compound a compound corresponding to the following formula I:

$$R^1-NHCO-\underset{\underset{O-CO-R^2}{|}}{CH}-CONH-R^1 \qquad (I)$$

wherein $R^1$ represents a carbocyclic or heterocyclic aromatic group, $R^2$ represents hydrogen, alkyl, alkenyl, aryl or acyl, and at least one of the radicals $R^1$ and $R^2$ contains a ballast radical.

3. A recording material as claimed in claim 2, wherein $R^1$ represents an optionally substituted phenyl group.

4. A recording material as claimed in claim 2 wherein $R^2$ is a carbamoyl radical or an acyl radical which is derived from an aliphatic or aromatic carboxylic acid.

5. A recording material as claimed in claim 2, wherein a compound corresponding to the following formula II is used as the non-diffusing, reducible, color-providing compound:

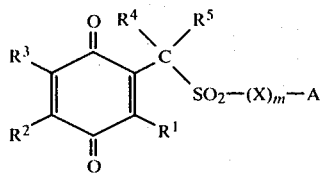

(II)

wherein $R^1$ represents alkyl or aryl, $R^2$ represents alkyl, aryl or a group which together with $R^3$ completes a fused ring, $R^3$ represents hydrogen, alkyl, aryl, hydroxyl, halogen, amino, alkylamino, dialkylamino including cyclic amino groups, acylamino, alkylthio, alkoxy, aroxy, sulfo, or a group which together with $R^2$ completes a fused ring, $R^4$ represents alkyl, $R^5$ represents hydrogen, A represents the radical of a diffusible dye or dye precursor, X represents a divalent connecting member, and m represents 0 or 1.

* * * * *